US007334269B2

(12) United States Patent
Segol

(10) Patent No.: US 7,334,269 B2
(45) Date of Patent: Feb. 26, 2008

(54) TZITZIOTH GARMENT

(76) Inventor: Avrahaum G. Segol, 588 W. End Ave., Apt. 15A, New York, NY (US) 10024

( * ) Notice: Subject to any disclaimer, the term of this patent is extended or adjusted under 35 U.S.C. 154(b) by 435 days.

(21) Appl. No.: 10/983,624

(22) Filed: Nov. 9, 2004

(65) Prior Publication Data

US 2005/0097651 A1 May 12, 2005

Related U.S. Application Data

(60) Provisional application No. 60/518,340, filed on Nov. 10, 2003.

(51) Int. Cl.
*A41B 1/00* (2006.01)

(52) U.S. Cl. ..... 2/115

(58) Field of Classification Search ..... 2/69, 2/2.5, 108, 247, 94, 114, 983, 102, 88, 106
See application file for complete search history.

(56) References Cited

U.S. PATENT DOCUMENTS

| | | | | | |
|---|---|---|---|---|---|
| 4,100,622 | A * | 7/1978 | Juelg, Jr. | ..... | 2/115 |
| 4,458,365 | A * | 7/1984 | Wood | ..... | 2/104 |
| 4,485,494 | A * | 12/1984 | Segol | ..... | 2/115 |
| 4,683,594 | A * | 8/1987 | Feinberg | ..... | 2/105 |
| 4,912,780 | A * | 4/1990 | Falack | ..... | 2/102 |
| 5,005,218 | A * | 4/1991 | Ganz | ..... | 2/69 |
| 5,227,215 | A * | 7/1993 | Sklar | ..... | 428/102 |
| 5,632,044 | A * | 5/1997 | Sloot | ..... | 2/102 |
| 5,664,259 | A * | 9/1997 | Budd | ..... | 2/115 |
| 6,035,440 | A * | 3/2000 | Woodyard | ..... | 2/102 |
| 6,131,199 | A * | 10/2000 | Bugel et al. | ..... | 2/102 |
| 6,353,935 | B1 * | 3/2002 | Antonini | ..... | 2/115 |
| 6,574,800 | B1 * | 6/2003 | Leger et al. | ..... | 2/114 |
| 7,010,812 | B1 * | 3/2006 | Cho et al. | ..... | 2/114 |
| 2003/0163861 | A1 * | 9/2003 | Avrahami | ..... | 2/69 |
| 2006/0050998 | A1 * | 3/2006 | Cohen | ..... | 383/41 |
| 2006/0185056 | A1 * | 8/2006 | Zwick | ..... | 2/115 |

* cited by examiner

*Primary Examiner*—Alissa Hoey
(74) *Attorney, Agent, or Firm*—Avrahaum G. Segol

(57) ABSTRACT

The present invention provides garments in which the torso front panel and the torso back panel are stitched together along at least a portion of each side of the garment, and along a remaining portion of each side the torso front panel and the torso back panel are left unstitched together. The unstitched together portion of each of the torso front panel and the torso back panel overlap along the side of the garment so as to enclose the torso of the wearer. Each intersection of the bottom edge and the corresponding overlapping side edge of each of the torso front panel and the torso back panel defines a corner that may be configured to be either angular or rounded. In a first preferred embodiment of the present invention, the portion stitched together along each side of the garment includes at least a portion of the circumference of each arm hole, and the unstitched together portion extends below each the arm hole. In a second preferred embodiment of the present invention, the portion stitched together along each side of the garment includes attachment to a yoke, and the unstitched together portion extends below the yoke.

4 Claims, 7 Drawing Sheets

TZITZIOTH GARMENT

This application claims priority from U.S. Provisional Patent Application 60/518,340 filed 10 Nov. 2003.

FIELD AND BACKGROUND OF THE INVENTION

The present invention relates to garments and, in particular, it concerns a tzitzioth garment construction about ⅔ or more open, but appearing closed.

It is known in Jewish religious law, or Halakah, observant Jews, since the time of Moses, are required to wear a "four-cornered garment" with specially braided fringe (tzitzioth) attached to each corner. This is considered a deed or "Mitzvah" performed in adherence to the Laws of Torah (Five Books Of Moses) where in observance calls for the children of Israel to attach tzitzioth " . . . to the (four) corners of your garments . . . ".

Traditionally this four-cornered tzitzioth garment has been constructed from a simple four-cornered acceptable piece of material with an ample circle cut out in the center as a hole through which the wearer's head may pass, thus allowing the full portion of material to simply drape down, falling against the wearer's body when the garment is placed on as clothing. The garment being fully open along all sides, with the tzitzioth having been appropriately attached before the garment is worn.

The four-cornered tzitzioth garment has most commonly been worn as an undergarment, most traditionally been worn by men, although some observant women have also worn tzitzioth. The four-cornered tzitzioth garment has undergone very little in the way of basic construction change over many years, perhaps centuries.

It should be noted that in substantially all prior art, a "four-cornered" tzitzioth garment comprises a garment of no less, and no more, than four corners, with the corners being constructed at a ninety degree angle. Likewise, all prior patent art relating to garments with tzitzioth, tallit, tallitoth, tallis, tallisim, contemplate a four-cornered item with a squared, ninety degree angulation of the four corners described, and/or illustrated.

U.S. Pat. No. 4,485,494, to the present inventor claimed "A garment comprising: a) a torso front piece; and b) a torso back piece encircling a portion of the front piece; and said pieces being stitched so that the upper portions of the pieces fully encircle the upper torso and wherein the pieces are opened at about the sides for about ⅔ the length of the sides with the back piece being provided with two free edges at the outside front of the garment and the front piece being provided with two free edges at the rear portion of the garment, whereby the garment when worn on the torso of the user gives the appearance of being closed. Although providing a radical variation from the standard tzitzioth garments, construction is somewhat complex. Further, as will be noticed in FIG. 1 of '494, at the time of the previous invention, even the present inventor's claim is directed to four corners and an illustrated angulation of the corners to be ninety degrees.

There is therefore a need for tzitzioth garment construction about ⅔ or more open, but appearing closed that is simple to construct, having four or more corners. It would be beneficial if the garment allowed for corners with an angulation other than ninety degrees. It would be of further benefit of the basic design of the garment were readily adaptable to a range of garments such as shirts, undershirts, suits and sport coats, jackets, overcoats, and robes for both men and women.

SUMMARY OF THE INVENTION

The present invention is tzitzioth garment construction about ⅔ or more open, but appearing closed.

According to the teachings of the present invention there is provided, a garment for covering at least the torso of a wearer, the garment comprising: a) a torso front panel; and b) a torso back panel, wherein the torso front panel and the torso back panel are stitched together along at least a portion of each side of the garment, and along a remaining portion of each the side the torso front panel and the torso back panel are left unstitched together, and the unstitched together portion of each of the torso front panel and the torso back panel overlap along the side of the garment so as to enclose the torso of the wearer.

According to a further teaching of the present invention, each intersection of a bottom edge and a side edge of the torso front panel and the torso back panel defines a corner.

According to a further teaching of the present invention, the corners are angular corners, and an angle of the corners is one chosen from the list of acute, right and obtuse.

According to a further teaching of the present invention, the angular corners each include at least one aperture for attaching tzitzioth according to Jewish Religious Law. The tzitzioth is an accessory article comprising twisted strands of fabric, a main winding fabric strand and multiple twisted strands. The main fabric strand is an un-dyed, natural color and the multiple twisted strands of material are color dyed to coordinate with the main body garment. The main winding fabric strand is twisted with the multiple twisted strands to form the tzitzioth.

According to a further teaching of the present invention, the corners are substantially rounded corners.

According to a further teaching of the present invention, the front torso panel is implemented as two panels configured to be releasably connected while the garment is worn, and the garment includes more than four corners.

According to a further teaching of the present invention, the back torso panel is configured such that at least a portion of the back torso panel fully encircles the torso of the wearer and side edges of the back torso panel are configured to be releasably connected while the garment is worn.

According to a further teaching of the present invention, the torso front panel and the torso back panel are formed from a single piece of material.

According to a further teaching of the present invention, the torso front panel and the torso back panel are formed from separated pieces of material that are stitched together.

According to a further teaching of the present invention, there is also provided a collar.

According to a further teaching of the present invention, there is also provided sleeves.

According to a further teaching of the present invention, the portion stitched together along each side of the garment includes at least a portion of a circumference of each armhole, and the unstitched together portion extends below each the armhole.

According to a further teaching of the present invention, the portion stitched together along each side of the garment includes attachment to a yoke, and the unstitched together portion extends below the yoke.

There is also provided according to the teachings of the present invention, a garment comprising: a) a garment body;

and b) at least one eyelet formed in a side region of the garment body so as to allow for the passage of tzitzioth, attached to a second garment worn under the garment body, through the garment body so as to be visible outside of the garment.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is tzitzioth garment construction about ⅔ or more open, but appearing closed.

The principles and operation of tzitzioth garment according to the present invention may be better understood with reference to the drawings and the accompanying description.

By way of introduction, since issuance of his U.S. Pat. No. 4,485,494, which is incorporated herein in full, the present inventor has made certain structural changes and improvements to the garment first described therein. These improvements include a design providing for simpler construction, a variety of different embodiments based on the new design, embodiments including more than four corners, and embodiments with corners having an angulation other than ninety degrees.

Therefore, the present invention provides garments in which the torso front panel and the torso back panel are stitched together along at least a portion of each side of the garment, and along a remaining portion of each side the torso front panel and the torso back panel are left unstitched together. The unstitched together portion of each of the torso front panel and the torso back panel overlap along the side of the garment so as to enclose the torso of the wearer. Each intersection of the bottom edge and the corresponding overlapping side edge of each of the torso front panel and the torso back panel defines a corner that may be configured to be either angular or rounded.

In a first preferred embodiment of the present invention, illustrated in FIGS. 1-8, the portion stitched together along each side of the garment includes at least a portion of the circumference of each arm hole, and the unstitched together portion extends below each the arm hole. In a second preferred embodiment of the present invention, illustrated in FIGS. 9-12, the portion stitched together along each side of the garment includes overlapping attachment to a yoke, and the unstitched together portion extends below the yoke. Therefore, the garments or the present invention are at least 51 precent open along the sides while appearing to be closed.

Figure 1:
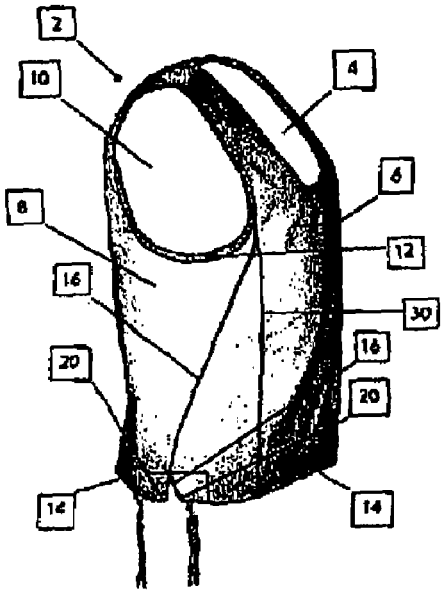
FIG. 1 shows the front and side of a first preferred embodiment of a tzitzioth garment constructed and operative according to the teachings of the present invention.
Figure 2:
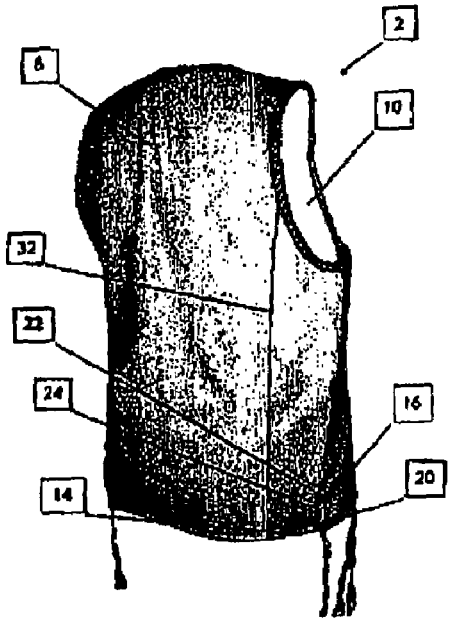
FIG. 2 shows the back and side of the embodiment of FIG. 1.

Referring now to the drawings, FIGS. 1 and 2 illustrate a first preferred embodiment of the present invention in its simplest form a "tank top tallit," generally referred to by numeral 2. This garment may be constructed for a single piece of material into which a head hole 4 is cut, thereby defining a front torso panel 6 and a back torso panel 8. Each of the panels 6 and 8 are cut so as to accommodate armholes 10 when the sides of the panels 6 and 8 are stitched together. In this embodiment, the sides of the panels 6 and 8 overlap each other and are stitched together around the bottom portion 12 of the armhole 10.

Although there may be numerous method of constructing a tank top tallit according to the present invention, one preferred method may be as follows.

Using one piece of material, the material is cut in a manner so that the neck line is center-cut allowing for head allowance and an even draping of the material on the front and back sides of the body so that the cloth at the nape of the neck lays closely without bunching, and the cloth on the chest side opening lays comfortably & modestly flat, thereby defining front 6 and back 8 torso panels.

The non-limiting length of the material in this example contemplates a length of material to cover flesh of the wearer from shoulder to below belt line, as may be commonly considered shirt length. The material has pre-measured armholes cut, contemplating overlapping of front 6 and back 8 materials at the armhole area when in final construct. Depending on the size of the wearer, the overlapped material at the armhole is determined by marking the bottom center of the armhole 10 and measuring a specific measurement forward of the back-side material towards the front of the garment, and a specific measurement backwards of the breast-side material towards the back of the garment so that the garment, once finished, will sufficiently cover the body flesh of the wearer.

The intersection of a bottom edge 14 and a side edge 16 of the torso front panel 6 and the torso back panel 8 defines a corner 20. A bottom "corner angle" is defined by the line of the bottom edge 14 and the side edge 16 to a point of attachment. Therefore, in this case, an eighty degree angle at corner 20*a*. A flat line edge is then created at the outermost upper tip edges of the overlapped material at the armhole to become an "insert" for construction purposes. A quarter inch hem is applied to the bottom edges 14 and the side edges 16.

Optional corner pocket pieces 22 may then cut to shape and folded so that sufficient material may be utilized as strengthening material, together with a pelon like underlying material as may or may not be required, where eyelets 22 will be stitched, above or to the side of the location where a turned pocket may result. Each of the corner pocket pieces 22 are sewn onto the garment and appropriately placed eyelets 22 are thereafter stitched in specific placement points as per dictate of Jewish Religious Law. It should be noted that for variation of the garments of the present invention upon which there is no intention to attach tzitzioth, the corner are formed as rounded corners 20*r*, see FIG. 12, and no eyelets need be formed.

In some variations of the basic garment, optional breast 30 and back 32 lines are iron pressed for the best & most accurate results on all four sides at front and back. The upper armhole is then stitched down from a center zero point at the side necklines to create a dart-seam finishing at an approximate one-half inch end point at the upper armhole. The lower sections 12 of the armholes 10 are then lined up at the center point so that the outer tips of the overlapped material at edged "inserts" may easily lay into the pre-pressed breast 30 and back 32 lines (see the variation of FIG. 5). The armholes 10 are then edge stitched in place. A quarter inch stitch is then applied to the four separate breast 30 and back 32 lines thereby securing the overlapped material in the desired application of back 8 over front 6, and front 6 under back 8, or visa versa. A finish over-stitch is applied to the breast 30 and back 32 lines so that a more attractive and secure garment results. Thereafter, the neckline and armholes are finished with binding material.

The resulting "tank top tallit" garment is approximately ⅔ or more open along the length of the sides, but appears to be enclosed by virtue of the wrap-around construction. Labels, etc., may be attached. Once the body of the garment is finished, in this case, with its eighty-degree corners, the tzitzioth are to be attached in the tradition of the end-user prior to wear.

It will be readily appreciated by one of ordinary skill in the art, that alternatively to constructing the tzitzioth garment as described above from a single piece of material and forming breast and back lines, up to six separate panels may be cut in specified configuration, with three of the pieces cut on the bias for trimming at the armholes and at the neckline. Such a garment may be more easily produced by a factory via use of multiple paneling sections to be sewn together. Thereby providing the ability to produce a better form fitting tailored appearance. Alternatively, if the garment is produce in knitted fabrics, and other like materials that can be sculpted to body form during the actual knitting and/or weaving process, a lesser number of panels is preferable with a lesser number of seams required to be stitched into the final garment.

Figure 3:
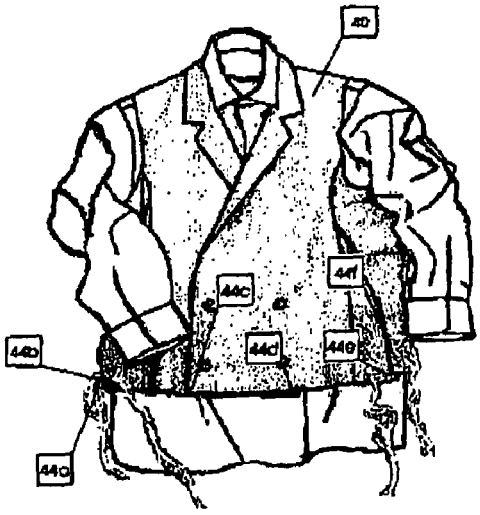
FIG. 3 shows the embodiment of FIG. 1 configured as a vest.
Figure 4:
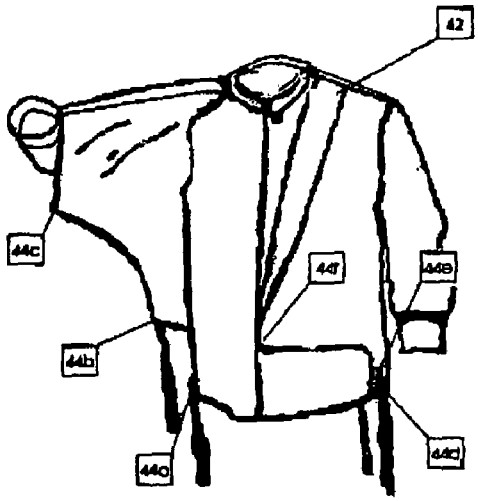
FIG. 4 shows the embodiment of FIG. 1 configures as a jacket.

FIGS. 3 and 4 illustrate the basic tzitzioth garment modified to a vest 40 configuration and a jacket 42 configuration respectively. It should be noted that the front panel in each of these two garments has been implemented as two panels that are closed by buttons. This creates additional corners on these garments, for a total of six corners, 44*a*, 44*b*, 44*c*, 44*d*, 44*e* and 44*f* in the vest and eight in the jacket, which also includes corners 44*g* and 44*h*. The jacket 42 of FIG. 4 also includes a back torso panel 8 that fully encircles the wearer and may be closed in the front.

Figure 5:
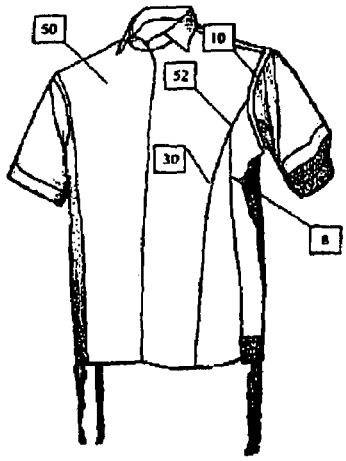
FIG. 5 shows a first variation of the embodiment of FIG. 1, the variation configured with short sleeves.
Figure 6:
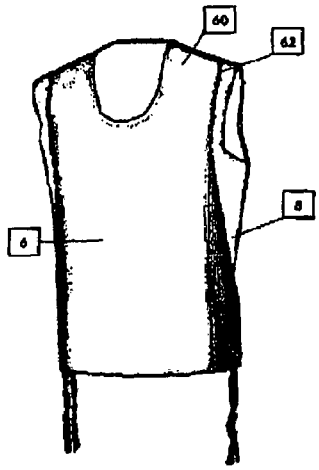
FIG. 6 shows a second variation of the embodiment of FIG. 1, configured as a tank top tallit.

FIG. 5 illustrates a first variation 50 of the first preferred embodiment of the tzitzioth garment of the present invention. Here, the breast line 30 starts at the armhole 10 and the upper portion of the back panel 8 is stitched into the breast line 30 for a portion 52 of the length of the breast line 30.

Figure 7:
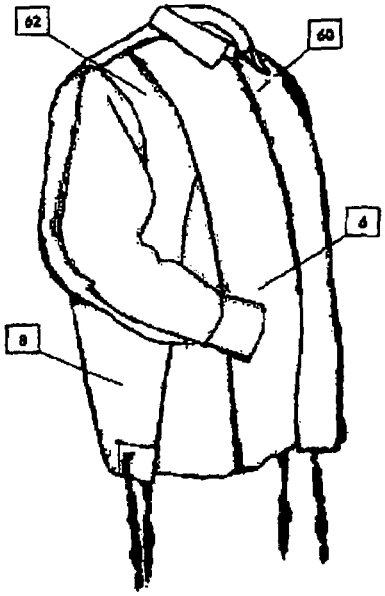
FIGS. 7 and 8 show the variation of FIG. 6 configured as a long sleeved shirt.
Figure 8:
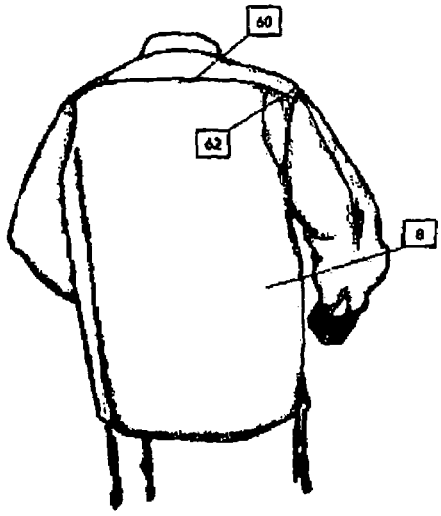
Figure 9:
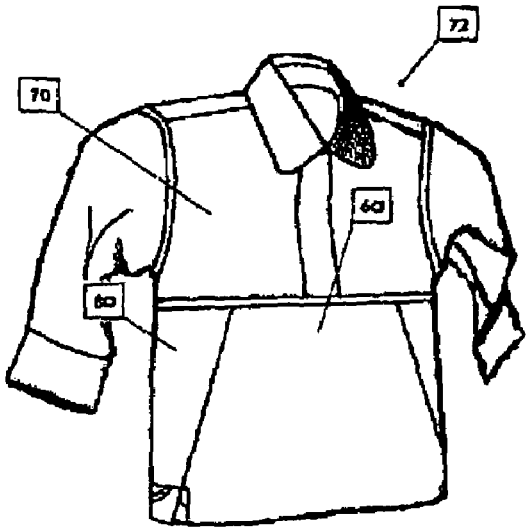
FIG. 9 shows the front of a second preferred embodiment of a tzitzioth garment constructed and operative according to the teachings of the present invention.
Figure 10:
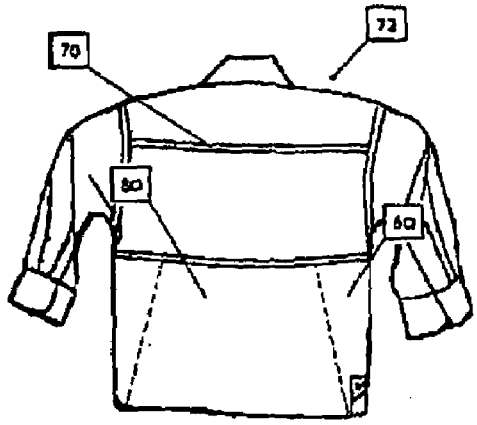
FIG. 10 shows the back of the embodiment of FIG. 9.
Figure 11:
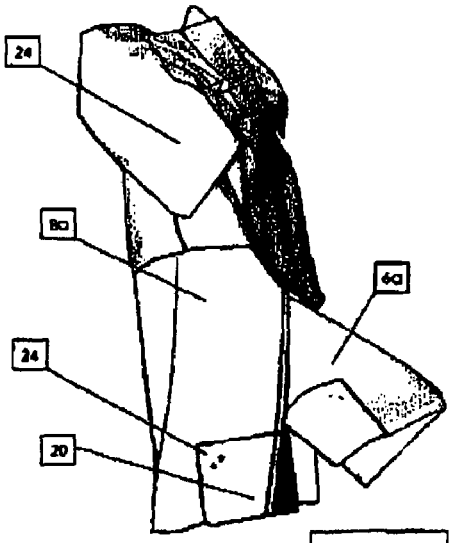
FIG. 11 shows the side of the embodiment of FIG. 9, shown here with angular corners.
Figure 12:
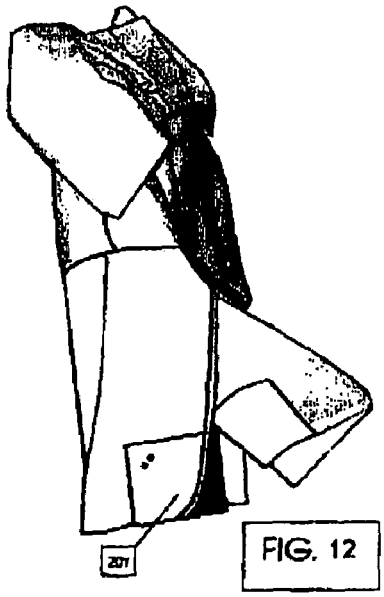
FIG. 12 shows the side of the embodiment of FIG. 9, shown here with rounded corners.

FIGS. 7-8 illustrates a second variation 60 of the first preferred embodiment of the present invention. These varied and non-limiting examples may be seen to utilize the shoulder "yoke" section 62 as the attachment region or as part of the front 6 and back 8 torso panels.

A second preferred embodiment of the tzitzioth garment 70 of the present invention is illustrated in FIGS. 9-12. In this embodiment, the tzitzioth garment includes an upper yoke portion 72 that is similar to a common shirt. The yoke portion 72 generally extends a short distance below the armholes 10. Attached to, and hanging below the yoke 72 are the overlapping front 6 and back 8 torso panels.

A non-limiting example of a method of construction for this embodiment is as follows. Beginning with the top portion of a shirt body 72 in common form with collar, neck band, shoulder yoke, half-front placket, long sleeves and cuffs, attach the overlapping lower front 6*a* and back 8*a* torso wrap-around panels by stitching them down to set points determined by approximate clavicle and breast lines, evenly set at the center-point of the sleeve closing seams, utilizing two pieces of overlapping material specially cut to create angular bottom "corner" constructions. The garment is then hemmed, and optional corner pockets may be added.

Figure 13:
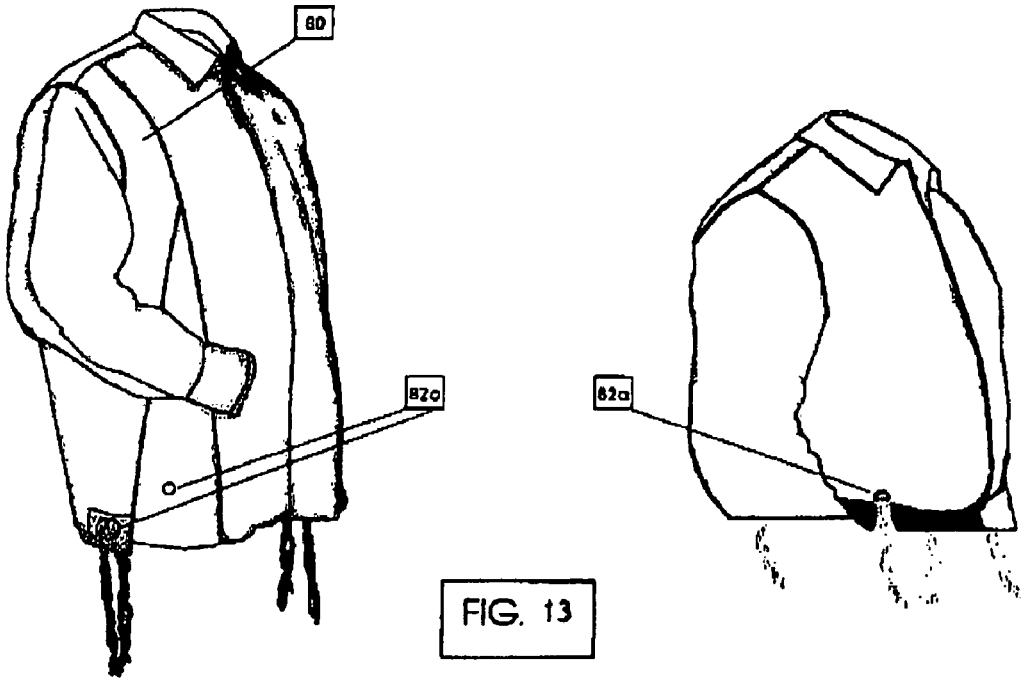
FIG. 13 shows the front and side of a third preferred embodiment of the present invention.

FIG. 13 illustrates a third preferred embodiment 80 of the garment of the present invention in which formed in the sides of the outer garment 80 to allow tzitzioth (not shown) attached to a second garment (not shown) being worn under the outer garment 80, to pass through the sides of the outer garment 80 and thereby be visible on the outside of the garment 80. It will be understood that the illustration of eyelets 82*a* and 82*b* is intended to show at least two non-limiting location in which the eyelets may be formed. It should be noted that the garment into which eyelets 82 are constructed need not be limited to a shirt type garment as illustrated here, and may include such garments as, but not be limited to, jackets, overcoats, pants, and overalls.

It will be readily appreciated that design features such as pockets, collar shape, sleeve length, cuff design, closures, such as but not limited to buttons, zippers, hook and loop fasteners, and snaps, and if the garment is configured as single or double breasted are considered to be variables within the scope of the present invention. It should also be noted that the garments of the present invention may be configured so as to be reversible.

In addition to creating a new, unique and novel means by which to construct a Tallit, a significant function to this construction rests in the fact that it greatly reduces production costs and simplifies critical employee training over the garment of U.S. Pat. No. 4,485,494, to the present inventor.

Furthermore, each and every application of such above described tallit garment is well within the proper scope of a refined and esoteric adherence to Jewish Religious Law, heretofore never actualized in product form with or without attachment of tzitzioth as is dictated by Jewish Religious Law.

Actualization of this invention also provides a needed product to a cultural specific market within the Jewish people worldwide, a national garment for nationals living in the Land of Yisra'el under the sovereign State of Israel, and an entirely new fashion for the world population at large who are neither Jewish, or living in the Land of Yisra'el, or citizens of the State of Israel. This invention constitutes the creation of a prophetic and holy garment referred to by the prophet Zacharia, in Chapter 8, wherein he speaks of a long awaited reunion with the Creator of all, the God of Yisra'el, and a veritable entry into an everlasting era of peace for this world.

It will be appreciated that the above descriptions are intended only to serve as examples, and that many other embodiments are possible within the spirit and the scope of the present invention.

What is claimed is:

1. A garment for covering at least the torso of a wearer, the garment comprising:

a torso front panel having an upper portion, lower portion and side edges; and;

a torso back panel having an upper portion, lower portion and side edges;

the front panel extending around the front, sides and at least some of the back portion of the wearer;

the back panel extending around the back, sides and at least some of the front portion of the wearer;

the front panel and the back panel overlap so that only a portion of the front torso panel is visible, the upper portion of the front panel and the upper portion of the back panel are stitched together and the lower portion of the front panel and lower portion of the back panel are unattached along the front panel and back panel side edges;

four corners are formed by the lower portion of the front and back panels at their side edges, the four corners having an angulation of other than 90 degrees or the corners are rounded;

apertures are formed in each corner of the front and back panels to accept accessory articles, an outer garment to be worn over the front and back panels, the outer garment having four apertures in which each of the accessory articles attached to the four corners of the front and back panels can extend through the four apertures on the outer garment so as to be visible outside of the outer garment.

2. The garment of claim 1, wherein the garment is reversible.

3. A garment for covering at least the torso of a wearer, the garment comprising:

a torso front panel having an upper portion, lower portion and side edges; and;

a torso back panel having an upper portion, lower portion and side edges;

the front panel extending around the front, sides and at least some of the back portion of the wearer;

the back panel extending around the back, sides and at least some of the front portion of the wearer;

the front panel and the back panel overlap so that only a portion of the front torso panel is visible, the upper portion of the front panel and the upper portion of the back panel are stitched together and the lower portion of the front panel and lower portion of the back panel are unattached along the front panel and back panel side edges;

four corners are formed by the lower portion of the front and back panels at their side edges, the four corners having an angulation of other than 90 degrees or the corners are rounded;

apertures are formed in each corner of the front and back panels to accept accessory articles, the accessory article is a tzitzioth comprising twisted strands of fabric, a main winding fabric strand which is an un-dyed natural color is twisted with remaining twisted strands of material which are color-dyed to coordinate with the main body garment.

4. The garment of claim 3, wherein the garment is reversible.

* * * * *